US006855018B2

(12) United States Patent
Burg

(10) Patent No.: US 6,855,018 B2
(45) Date of Patent: Feb. 15, 2005

(54) PROPULSION SYSTEM FOR BOATS

(76) Inventor: Donald E. Burg, 15840 SW. 84 Ave., Miami, FL (US) 33157

( * ) Notice: Subject to any disclaimer, the term of this patent is extended or adjusted under 35 U.S.C. 154(b) by 0 days.

(21) Appl. No.: 10/336,026

(22) Filed: Jan. 2, 2003

(65) Prior Publication Data

US 2003/0124920 A1 Jul. 3, 2003

Related U.S. Application Data

(63) Continuation-in-part of application No. 09/809,414, filed on Mar. 15, 2001, now Pat. No. 6,629,866, and a continuation-in-part of application No. 09/702,905, filed on Oct. 26, 2000, now abandoned.

(51) Int. Cl.[7] ..... B63H 11/00
(52) U.S. Cl. ..... 440/38
(58) Field of Search ..... 440/38, 46

(56) References Cited

U.S. PATENT DOCUMENTS 3,253,567 A * 5/1966 Patton, Jr. ..... 440/46
4,689,026 A * 8/1987 Small ..... 440/66
5,505,639 A * 4/1996 Burg ..... 440/42
6,238,257 B1 * 5/2001 Platzer et al. ..... 440/42
6,629,866 B2 * 10/2003 Burg ..... 440/38

FOREIGN PATENT DOCUMENTS

JP 56-120497 * 9/1981

* cited by examiner

*Primary Examiner*—Ed Swinehart
(74) *Attorney, Agent, or Firm*—Robert J. Van Der Wall

(57) ABSTRACT

Presented is an efficient propulsion system for boats that operates, with the boat going forward at high speeds, with its fluid accelerating rotor operating on an air and water mixture. The rotor is disposed, as seen in vertical transverse planes of the boat, at least in its majority to sides of hulls of the boat. The lower periphery of the rotor is proximal a keel of the boat when the boat is moving forward at high speed thereby insuring a shallow draft situation. When the boat is going in reverse, the rotor is supplied only with water so that it can act to pressurize the water in its discharge. The pressurized water from the rotor discharge is then reversed by one or more reversing buckets. An inlet flow adjusting system, inlet flow directing vanes, and air fences are options. This efficient new propulsion system for boats may be applied to all manner of boats including monohulls and multi-hulls.

43 Claims, 5 Drawing Sheets

PROPULSION SYSTEM FOR BOATS

CROSS REFERENCE TO OTHER APPLICATIONS

This application is a continuation-in-part-application to Applicant's earlier filed applications Ser. No. 09/702,905 filed Oct. 26, 2000, now abandoned and Ser. No. 09/809,414 filed Mar. 15, 2001, now U.S. Pat. No. 6,629,866.

BACKGROUND OF THE INVENTION

Surface propellers that operate partially submerged are a popular means of propelling high-speed boats. These surface propellers are normally mounted aft of the transoms of boats so that they receive inlet water that arrives at the surface propeller more or less level and at the horizontal centerline of the surface propeller. A disadvantage of the prior surface propeller technology is that they extend below the keels of the boat by about one half of the propeller diameter. They are subject to high structural shock loads caused when the surface propeller blades impact the water surface on each revolution. Further, these surface propellers must be made as thin as possible in construction to enhance efficiency which results in a highly stressed propeller blade design that cannot handle high impacts that occur when the propeller strikes foreign objects. One solution is to raise the surface propeller above the keel of the boat and encase it in a housing as has been demonstrated in Applicant's Hydro-Air Drive inventions.

The instant invention is a variation of the Hydro-Air Drive. It has application to all manner of boats but has particular application to multi-hulled boats such as catamarans. In the case of application to multi-hulled boats, the fluid accelerating rotor is located on the inboard sides of the hulls so that it does not extend outboard of the beam of the boat. When installed on the outboard sides of hulls of monohull or multi-hulled boats, the beam must be increased. The rotors or propellers are raised such that their lower peripheries are normally higher than a keel of the boat to insure shallow draft capabilities. On relatively small vessels, say up to about 100 feet in length, the rotor is operating with at least some of its inlet water from the waves generated by the bow and other portions of the hull forward of the rotor. Since the water level generated by these bow waves is above the ambient sea level, it is possible to operate with the stated raised rotor. On larger vessels the aft end of the hulls may be submerged deep enough so that less disturbed water is taken in by the instant invention's fluid accelerating rotor. In any case, the instant invention boat propulsion system makes for a simple propulsor with an elevated rotor thereby providing a very shallow draft multi-hulled or monohull boat.

SUMMARY OF THE INVENTION

With the foregoing in mind, it is the principal object of the preferred embodiment of the instant invention to provide an improved propulsion system for boats including a first fluid accelerating rotor with said first fluid accelerating rotor disposed, at least in its majority, between hulls of a multi-hulled boat.

It is another object of the invention that the improved propulsion system can also be applied to the outside of hulls of multi-hull or monohull boats.

It is an object of the invention that the propulsion system can utilize rotors or propellers that are either enclosed in a rotor housing or open with no housing.

It is a further object of the invention that surfaces of the hull forward of the rotor will preferably be angled to horizontal to thereby direct the water into the rotor.

It is a directly related object of the invention that the just mentioned angled surfaces will also contribute to the boat having a smoother ride in rough seas.

A related object of the invention is that, when the boat is traveling forward at high speed where high speed is defined as speeds of 15 knots or more, an elevation of a lower portion of said first fluid accelerating rotor is proximal an elevation of a keel of the boat.

Another object of the invention is that a periphery of said first fluid accelerating rotor can be, at least in its majority, surrounded by a rotor housing.

A further object of the invention is that two or more water accelerating rotor propulsors may be employed between the hulls of a multi-hulled boat.

A further object of the invention is that a rudder be disposed aft of the first fluid accelerating rotor.

Another object of the invention is that a reversing mechanism be disposed, at least in its majority, aft of the first fluid accelerating rotor.

A directly related object of the invention is that the reversing mechanism may include a reversing bucket element.

A further directly related object of the invention is that the reversing mechanism may include at least two reversing bucket elements.

Another object of the invention is that it may include a secondary inlet gas supply means to supply gas to the first fluid accelerating rotor when the boat is traveling forward at high speed and liquid to the first fluid accelerating rotor when the boat is traveling in reverse.

A related object of the invention is that the secondary inlet gas supply means may include a step that creates a waterline that separates the gas and the liquid when the boat is traveling forward at high speed.

Yet another object of the invention is that it may include an inlet liquid level adjustment means forward of the first fluid accelerating rotor.

Still another object of the invention is that its rotor housing may include a primary fluid inlet disposed, at least in its majority, forward of the first fluid accelerating rotor.

A related object of the invention is that it may further include one or more flow directing vanes forward of the fluid accelerating rotor.

A directly related object of the invention is that said flow directing vanes may be, at least in part, airfoil shaped.

Yet another object of the invention is that an air fence may be utilized to restrict surface air from entering the propulsor primary water inlet.

It is a further object of the invention that the instant invention boat propulsion system may be mounted on an angled surface, as seen in a vertical transverse plane of the boat, that is either between hulls on a multi-hulled boat or outboard of multi-hull or monohull boats.

DETAILED DESCRIPTION

Figure 1:
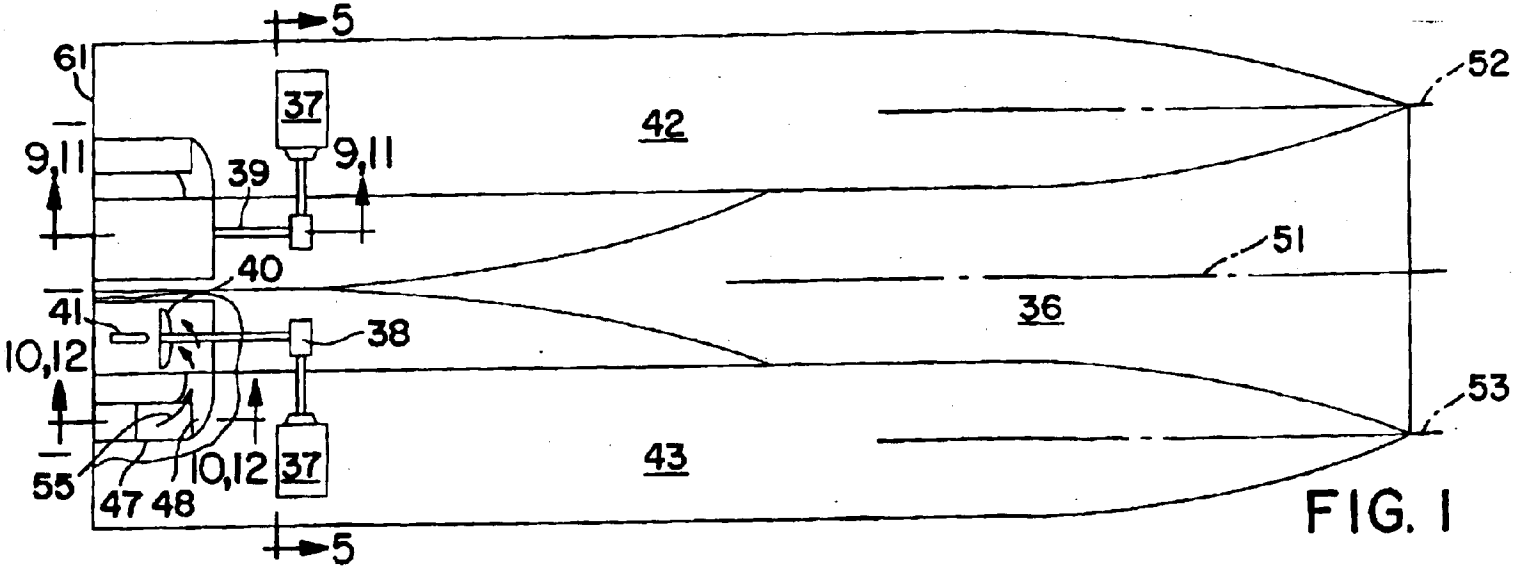
FIG. 1 presents a topside plan view of a multi-hulled boat with the upper deck removed thereby showing the machinery layouts of two of the instant invention propulsion systems. A portion of the lower deck is removed on the starboard side to show details of one of the water accelerating rotors and a rudder.

FIG. 1 presents a top plan view of a multi-hulled boat 36 having port sidehull 42 and starboard sidehull 43. In this case, this multi-hulled boat 36 has its main deck and a portion of the lower hull deck removed to show drive engines 37, right angle gearbox 38, drive shaft 39, fluid accelerating rotor 40, and rudder 41 of a preferred embodiment of the instant invention propulsion system 60. A secondary fluid inlet 47, secondary fluid inlet passageway 48, gas flow arrows 55, and transom 61 are also shown.

Figure 2:
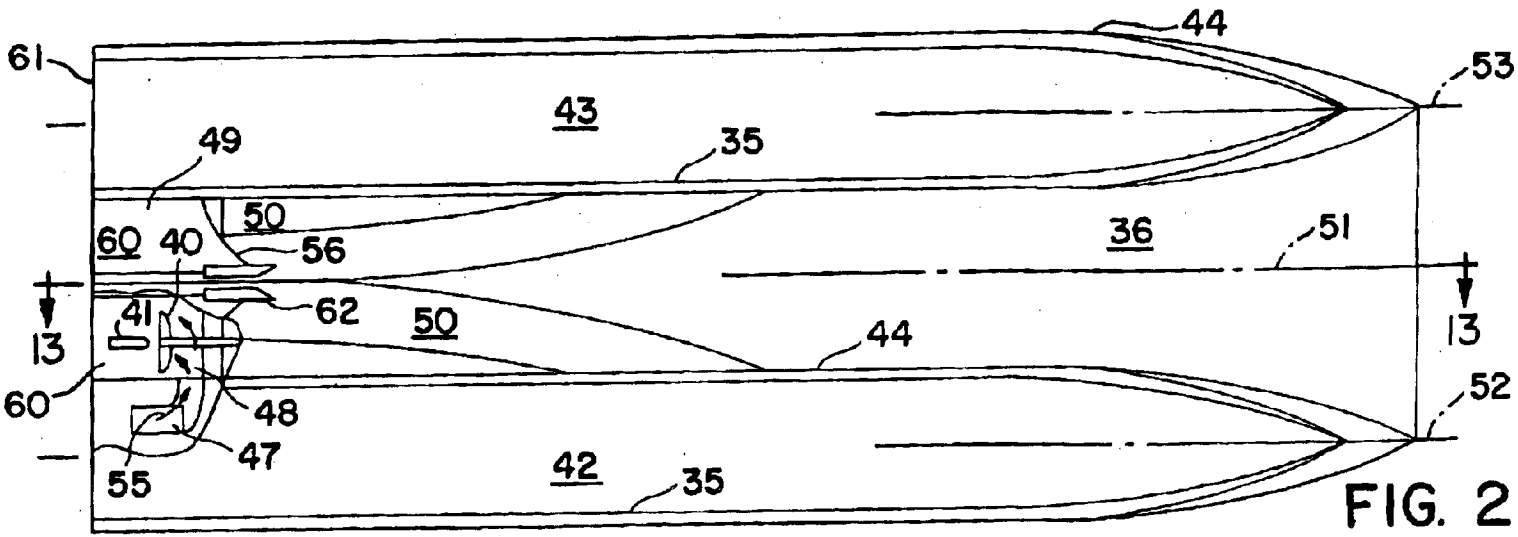
FIG. 2 is a bottom plan view of the same multi-hulled boat as presented in FIG. 1. In this case, part of the bottom hull plating is removed to show a fluid accelerating rotor.

FIG. 2 gives a bottom plan view of the multi-hulled boat 36 of FIG. 1. This shows sidehull chines 44, keels 35, and angled hull surfaces 50. Note that the fluid accelerating rotor housings 49, while preferred, are not necessary for the instant invention to function. The primary fluid inlets 56 are shown as the forward portions of the rotor housings 49 here. Note the air fences 62 that are employed to: 1) reduce air ingestion into the inlet lip 56 and 2) straighten out flow arriving at the inlet lip 56.

Figure 3:
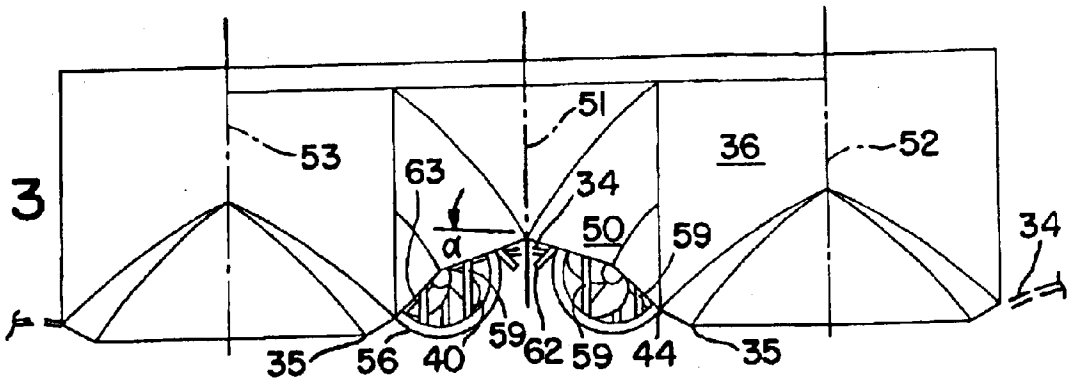
FIG. 3 presents a bow view of a multi-hulled boat incorporating the instant invention as it is configured for high speed forward operation. This figure shows a first and a second fluid accelerating rotor. Note that in this preferred embodiment case that the fluid accelerating rotors are internal to rotor housings. While this is the preferred and most efficient and most protected way to mount the rotors, it is quite possible and within the scope and spirit of the invention that the rotor housings are optional and not needed to make the instant invention function.

FIG. 3 presents a bow view of a multi-hulled boat 36 that utilizes two of the instant invention propulsors 60. Note that, while a catamaran type multi-hull is shown here for illustrative purposes, a boat with any number of connected hulls beyond one is considered applicable for the multi-hull installations of the instant invention. It is also possible to install the instant invention in monohull boats as is shown in FIGS. 14, 15, 16, and 17.

Additional items shown in FIG. 3 are active waterlines 34, hull vertical centerline plane 51, port sidehull vertical centerline plane 52, and starboard sidehull centerline plane 53. Note the rather steeply angled connecting hull stern section 50 here. It is a benefit to have this connecting hull stem section 50 of an inverted-V shape or similar angled shape as that channels water to the instant invention drives 60 when moving forward at high speeds. Note the active waterline 34 location here. The primary fluid inlets 56, primary inlet fluid guide vanes 59, and air fences 62 are also shown. The inlet guide vanes 59 are preferably airfoil shaped reduce their resistance to flow. High speeds are defined as being speeds of more than 15 knots for purposes of this application.

Angle $\alpha$ is shown on FIG. 3. This defines a best angle to horizontal of a rotor inlet surface that, as seen in a vertical transverse plane of the boat, is an average of at least 15 degrees over a majority of its width and is disposed, at least in its majority, to a side of a hull of the boat. For purposes of this application, other range of values for this angle are set as being at least 20, 25, or 30 degrees. These angles give good seakeeping qualities and also reasonable inflow of water to the fluid accelerating rotor 40. This average angle is meant to include the average angle over the distance covered by the rotor inlet surface 63, as seen in a vertical transverse plane of the boat, forward of the fluid accelerating rotor 40.

Figure 4:
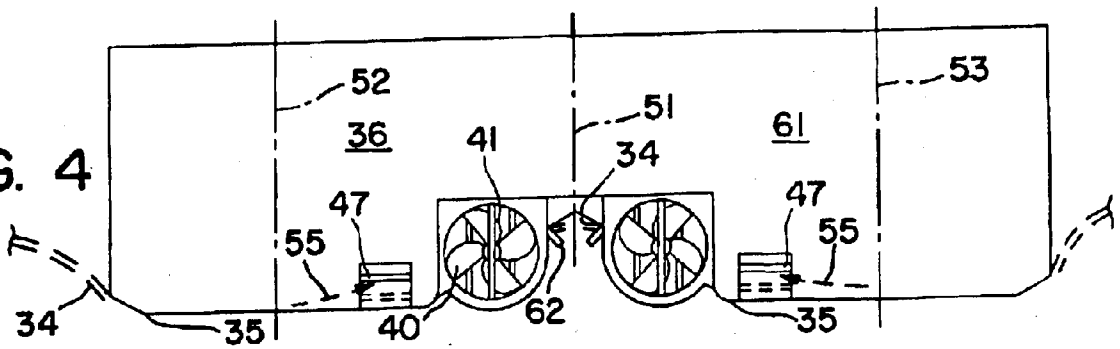
FIG. 4 gives a stern view of the multi-hulled boat incorporating the instant invention shown in FIG. 3.

FIG. 4 gives a stern view of the multi-hulled boat 36 of FIG. 3. Note the secondary fluid inlets 47 that are supplying air here as can be seen by noting air flow arrows 55. This is the case since the multi-hulled boat 36 is traveling forward at high speeds so the transom 61 is essentially dry.

Figure 5:
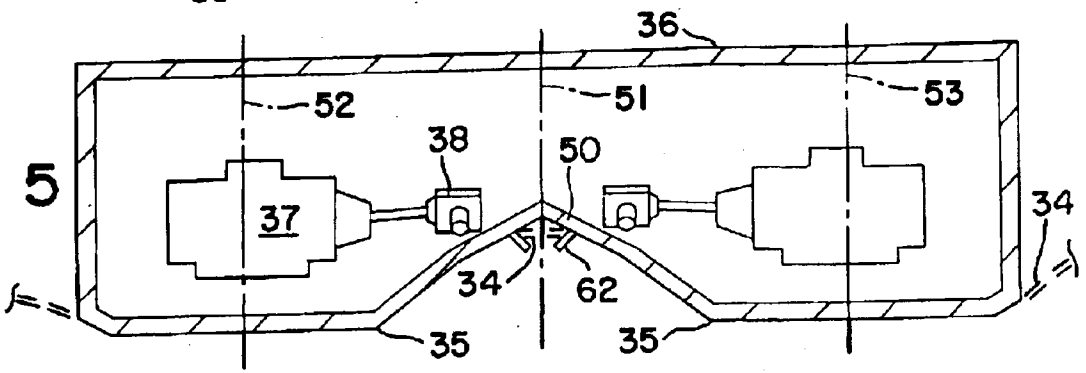
FIG. 5 is a cross-section, as taken through vertical plane 5—5 of FIG. 1, that shows one possible way to arrange the drive machinery. Any number of other drive systems including sideways angled shafts from fore and aft mounted engines, electric motor drives at the water accelerating rotors, or the like may be utilized. The machinery layout shown is simply a preferred and simple way to arrange the machinery.

FIG. 5 presents a cross-section, as taken through line 5—5 of FIG. 1, that shows a preferred way of installing drive machinery. Many other propulsion machinery arrangements and options are, of course, possible and are considered well within the scope and spirit of the instant invention.

Figure 6:
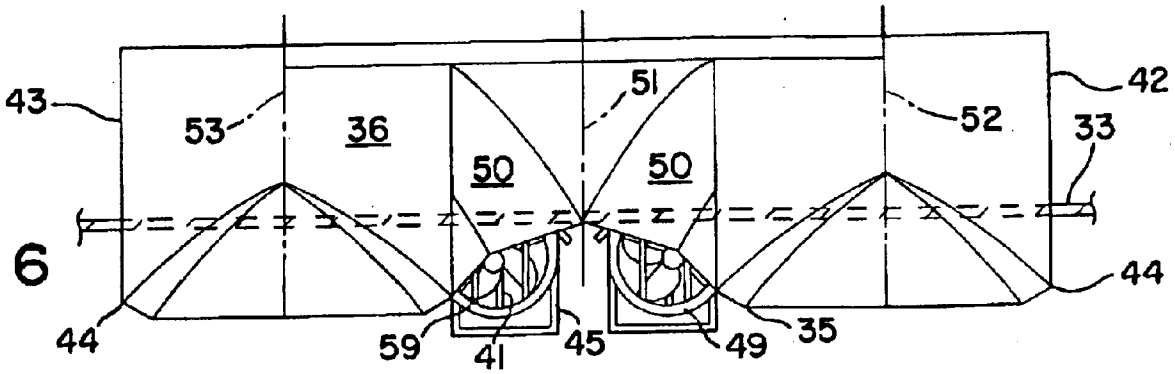
FIG. 6 presents a bow view of a multi-hulled boat with the instant invention propulsors installed. In this case they are operating in reverse with the reversing buckets down to direct water forward during reversing.

FIG. 6 is the save bow view as presented in FIG. 3 except a reversing bucket element 45 is actuated here to provide thrust for reversing.

Figure 7:
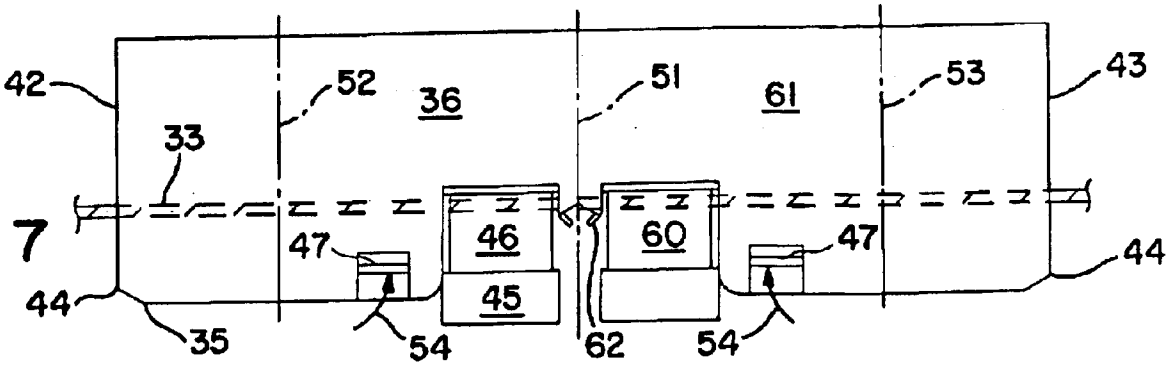
FIG. 7 is a stern view of the multi-hulled boat presented in FIG. 6.

FIG. 7 gives the same stem view as that presented in FIG. 4 except a first reversing bucket element 45 and a second reversing bucket element 46 are actuated in their reversing or down positions here to thereby reverse flow discharging from the fluid accelerating rotor thus creating reverse thrust. Note the ambient static waterline 33 here that is well up on the transom 81. The fact that the secondary fluid inlets 47 are submerged means that they are capable of supply only, at least mainly, water to the fluid accelerating rotor as can be seen by examination of water flow arrows 54.

Figure 8:
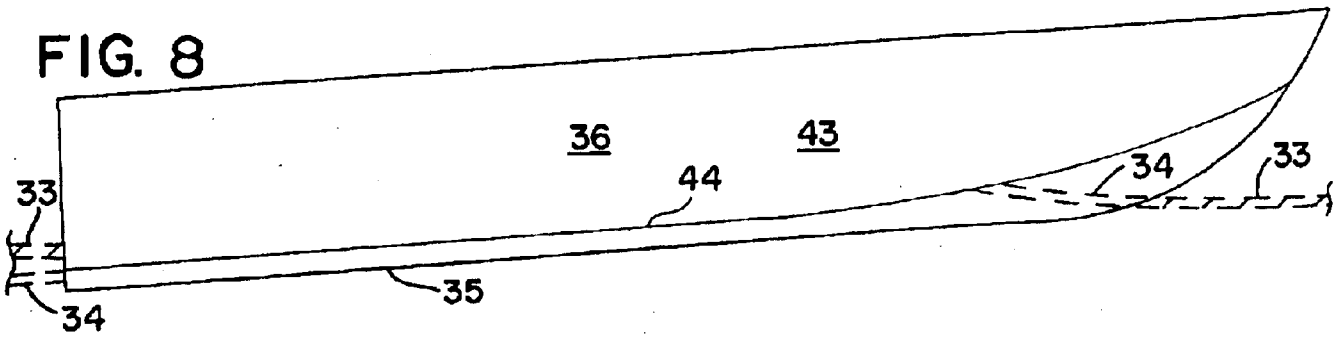
FIG. 8 is a profile view of a multi-hulled boat that shows how cleanly the instant invention propulsion systems install resulting in an attractive appearance here.

FIG. 8 is a profile view of a multi-hulled boat 35 that has the instant invention propulsor installed and is being propelled forward at high speed in a calm sea. The ambient calm sea waterline 33 as well as the bow wave generated active waterline 34 can be seen here.

Figure 9:
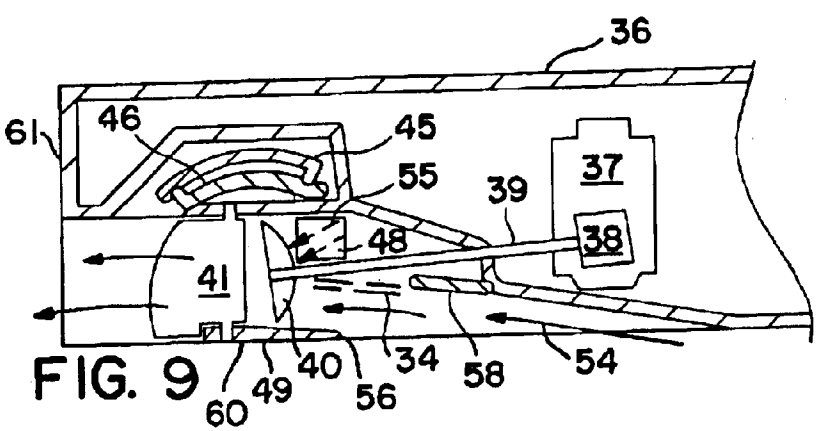
FIG. 9 presents a partial cross-sectional view, as taken through vertical plane 9—9 of FIG. 1, that shows rotor inlet water and air flows during high speed forward operation.

FIG. 9 is a partial cross-sectional view, as taken through vertical plane 9—9 of FIG. 1, that shows operation of the instant invention propulsor 60 when driving the multi-hulled boat 36 forward at high speed. A primary inlet flow directing valve 58 may be used to adjust the level of water reaching the fluid accelerating rotor 40. Note the air flow entering through the passage 48 that supplies the fluid accelerating rotor 40.

Figure 10:
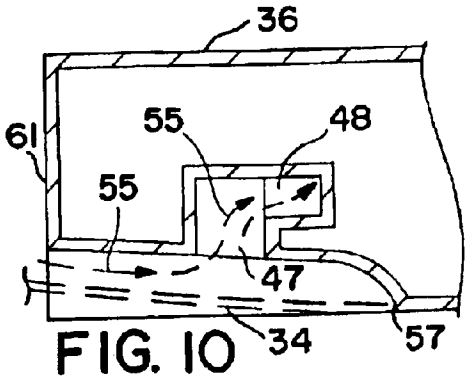
FIG. 10 is a partial cross-sectional view, as taken through line 10—10 of FIG. 1, that shows the inlet means that supplies air to the fluid accelerating rotor during high speed forward operation. Note that the water separating step forward insures that a waterline separates the water from the air that is taken in through the secondary fluid inlet.

FIG. 10 gives a partial cross-sectional view, as taken through vertical plane 10—10, of FIG. 1, that illustrates how the air and water are separated by an active waterline 34 aft of water separating step 57. This is necessary to allow the secondary fluid inlet 47 to supply air to the fluid accelerating rotor during forward high speed operation.

Figure 11:
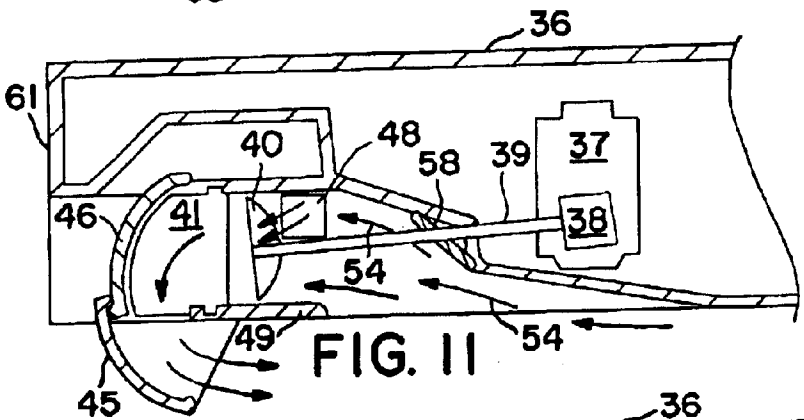
FIG. 11 gives a partial cross-sectional view, as taken through line 11—11 of FIG. 1, that shows that water is being supplied to the fluid accelerating rotor during reversing. After passing through the rotor, the water is reversed by means of the flow reversing bucket(s) to thereby generate reversing thrust.

FIG. 11 presents the same partial cross-sectional view as that given in FIG. 9, as taken through vertical plane 11—11 of FIG. 1, but with the first reversing bucket element 45 and the second reversing bucket element 46 actuated so as to direct fluid flow forward and thereby create reverse thrust. It is to be noted that any number of reversing bucket elements, from one to many, may be utilized. However, use of two or three elements is most desired as that makes for a more compact reversing system.

Figure 12:
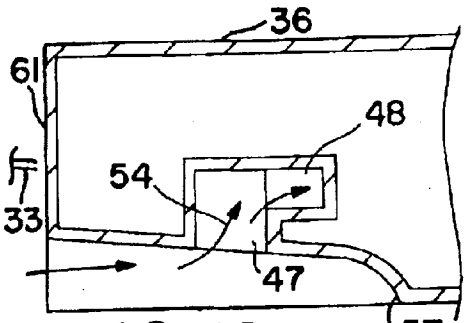
FIG. 12 is a partial cross-sectional view, as taken through line 12—12 of FIG. 1, that shows how only water is taken in to supply the rotor during reversing. It is possible of course to have some small portions of the fluid flow taken in here to be air; however, that is not considered to be in sufficient amount to be considered as part of the fluid flow here.

FIG. 12 gives the same partial cross-sectional view as that given in FIG. 10, as taken through vertical plane 10—10 of FIG. 1, but in this case with ambient calm waterline 33 high up on the transom 61 since the multi-hulled boat 36 is operating in reverse. The thing to note here is that water rather than air is flowing into the secondary inlet 47.

Figure 13:
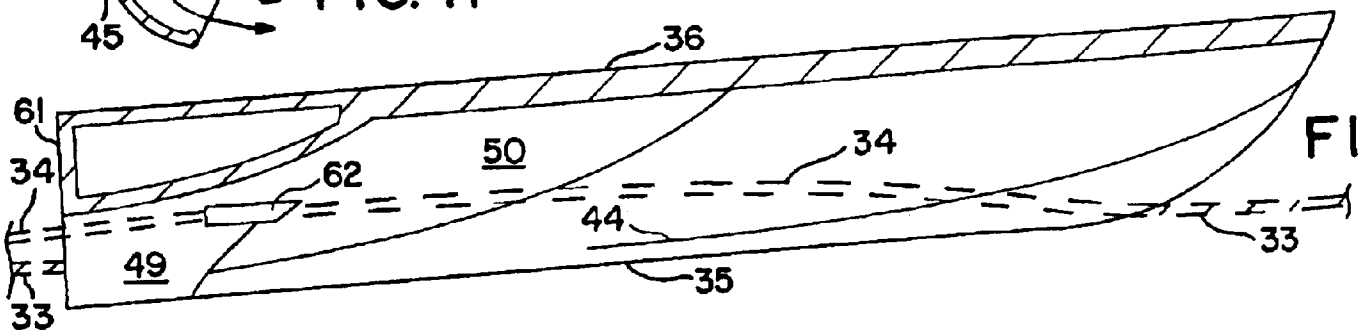
FIG. 13 presents a cross-sectional view, as taken through line 13—13 of FIG. 2, that shows how the hull generated bow wave builds up going aft and then supplies the instant invention propulsor's fluid accelerating rotor with water.

FIG. 13 presents a centerline cross-sectional view, as taken through vertical plane 13—13 of FIG. 2, that shows the calm sea ambient waterline 33 where it intersects the multi-hulled boat 36 forward and aft. What is more important is seeing how the bow wave created active waterline 34 rises going from forward to aft thereby supplying water to the primary inlet 56.

Figure 14:
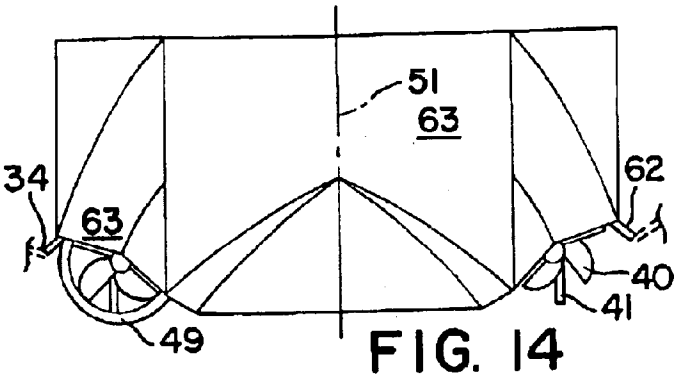
FIG. 14 gives a bow view of a monohull version of the instant invention. Note that, for illustrative purposes, the starboard propeller or rotor 40 is internal to a rotor housing 49 while the port rotor 40 is not. This variant is done simply to show how either concept will work and is within the scope and spirit of the instant invention.

FIG. 14 presents a simple variation whereby the instant invention is installed in a monohull boat 63. In this bow view, for illustrative purposes, the port inventive boat propulsion system is shown less a rotor housing. This open rotor approach is a variation that is well within the scope and intent of the instant invention.

Figure 15:
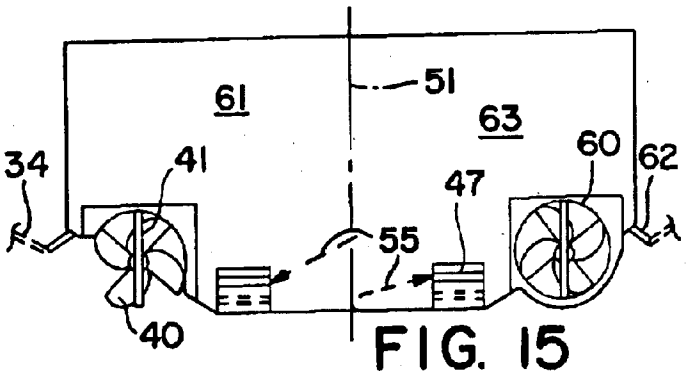
FIG. 15 is a stern view of the monohull version given in FIG. 14.

FIG. 15 is a stem view of the monohull boat 63 of FIG. 14.

Figure 16:
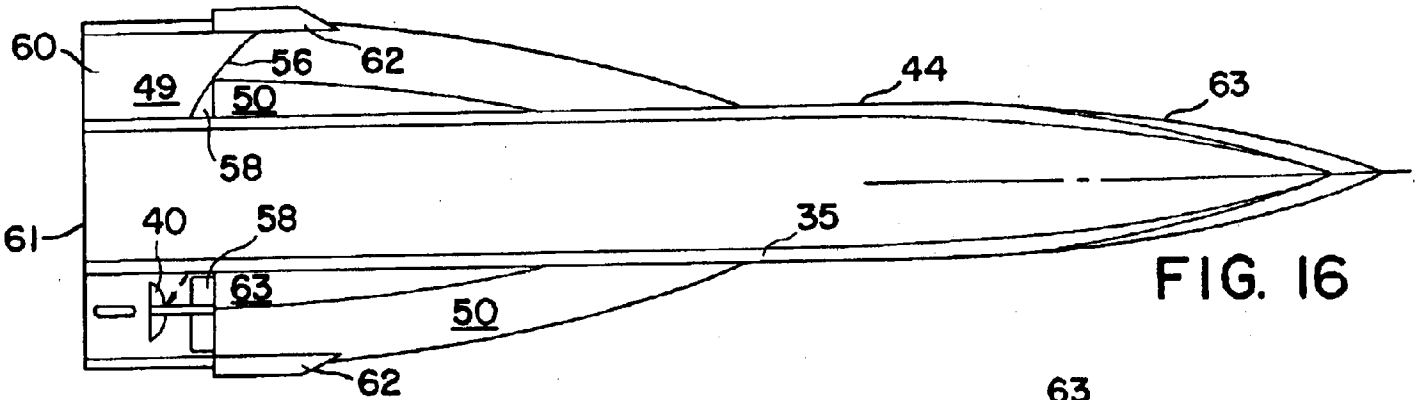
FIG. 16 is a bottom plan view of the instant invention propulsion system as installed in a monohull boat of FIGS. 14 and 15. Note the open situation for the port rotor 40. The inlet flow adjustment vanes 58 are shown on both the port and starboard sides.

FIG. 16 gives a bottom plan view of the monohull boat 63 of FIGS. 14 and 15. Note the open water propeller or rotor 40 on the port side here. The air fences 62 are shown here also.

Figure 17:
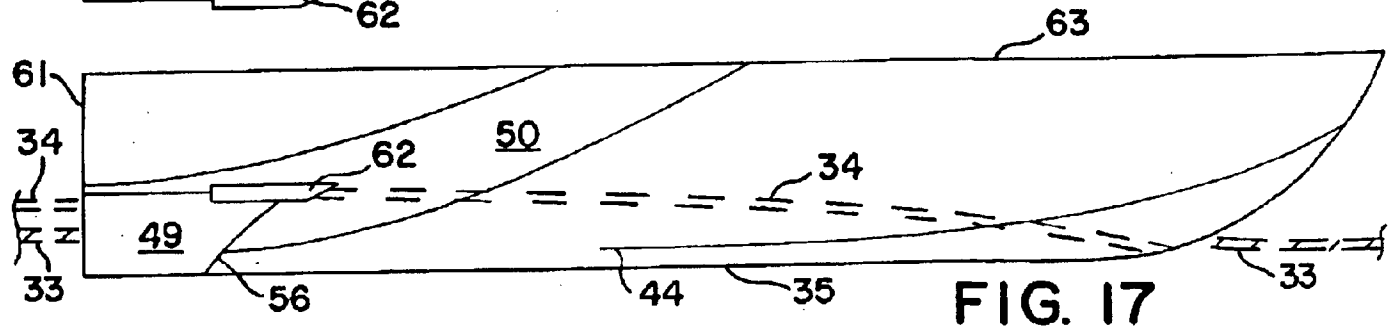
FIG. 17 presents a profile view of the monohull boat 63 as presented in FIGS. 14, 15, and 16 taken from the starboard side.

FIG. 17 is a profile view of the monohull boat of FIGS. 14, 15, and 16. Note the similarities in concept of the monohull installations to the multi-hull variants of the previous FIGS. 1–13. In summary, the instant invention boat propulsion system may be installed equally well in both monohull and multi-hull boats.

While the invention has been described in connection with a preferred and several alternative embodiments, it will be understood that there is no intention to thereby limit the invention. On the contrary, there is intended to be covered all alternatives, modifications and equivalents as may be included within the spirit and scope of the invention as defined by the appended claims, which are the sole definition of the invention.

What I claim is:

1. In an improved propulsion system for boats, the improvement comprising:

a first propulsion system including a first fluid accelerating rotor with said first fluid accelerating rotor disposed, at least in its majority, between hulls of a multi-hulled boat and operating with gas and water supplied to forward portions of said first fluid accelerating rotor when the multi-hulled boat is traveling forward at high speed, an elevation of a lower portion of said first fluid accelerating rotor proximal an elevation of a keel of the multi-hulled boat, and a periphery of said first fluid accelerating rotor, at least in its majority, surrounded by a rotor housing.

2. The improved propulsion system of claim 1 wherein a second propulsion system including a second fluid accelerating rotor with said second fluid accelerating rotor disposed, at least in its majority, between hulls of a multi-hulled boat and operating with gas and water supplied to forward portions of said second fluid accelerating rotor when the multi-hulled boat is traveling forward at high speed, an elevation of a lower portion of said second fluid accelerating rotor proximal an elevation of a keel of the multi-hulled boat, and a periphery of said second fluid accelerating rotor, at least in its majority, surrounded by a rotor housing.

3. The improved propulsion system of claim 1 which further comprises a rudder disposed aft of the first fluid accelerating rotor.

4. The improved propulsion system of claim 1 which further comprises a reversing mechanism that is disposed, at least in its majority, aft of the first fluid accelerating rotor.

5. The improved propulsion system of claim 4 wherein the reversing mechanism includes a reversing bucket element.

6. The improved propulsion system of claim 4 wherein the reversing mechanism includes at least two reversing bucket elements.

7. The improved propulsion system of claim 1 which further includes a secondary inlet gas supply means to supply gas to the first fluid accelerating rotor when the multi-hulled boat is traveling forward at high speed and liquid to the first fluid accelerating rotor when the multi-hulled boat is traveling in reverse.

8. The improved propulsion system of claim 7 wherein the secondary inlet gas supply means includes a step that creates a waterline that separates the gas and the liquid when the multi-hulled boat is traveling forward at high speed.

9. The improved propulsion system of claim 1 wherein said rotor housing includes a primary fluid inlet disposed, at least in its majority, forward of the first fluid accelerating rotor.

10. The improved propulsion system of claim 1 which further includes an inlet liquid level adjustment means forward of the first fluid accelerating rotor.

11. The improved propulsion system of claim 9 wherein the primary fluid inlet is in mechanical communication with one or more flow directing vanes.

12. The improved propulsion system of claim 11 wherein said flow directing vanes are, at least in part, airfoil shaped.

13. The improved propulsion system of claim 9 which further includes an air fence proximal the primary fluid inlet.

14. The improved propulsion system of claim 9 wherein the primary fluid inlet is proximal a connecting surface that connects two hulls of the multi-hull boat with said surface, as seen in a vertical transverse plane of the multi-hull boat, angled to horizontal over a majority of its width.

15. The improved propulsion system of claim 14 wherein said connecting surface, as seen in a vertical transverse plane of the multi-hull boat, is at least in part of an inverted-V shape.

16. In an improved propulsion system for boats, the improvement comprising:

a first propulsion system including a first fluid accelerating rotor with said first fluid accelerating rotor operating with gas and water supplied to forward portions of said first fluid accelerating rotor when the boat is traveling forward at high speed, an elevation of a lower portion of said first fluid accelerating rotor proximal an elevation of a keel of the boat, and which further includes a secondary inlet fluid supply means to supply gas to the first fluid accelerating rotor when the boat is traveling forward at high speed and liquid to the first fluid accelerating rotor when the boat is traveling in reverse and wherein the secondary inlet gas supply means includes a step that creates a waterline that separates the gas and the liquid when the boat is traveling forward at high speed.

17. The improved propulsion system of claim 16 wherein a second propulsion system including a second fluid accelerating rotor with said second fluid accelerating rotor operating with gas and water supplied to forward portions of said second fluid accelerating rotor when the boat is traveling forward at high speed, an elevation of a lower portion of said second fluid accelerating rotor proximal an elevation of a keel of the boat, and which further includes a secondary inlet gas supply means to supply gas to the first fluid accelerating rotor when the boat is traveling forward at high speed and liquid to the second fluid accelerating rotor when the boat is traveling in reverse.

18. The improved propulsion system of claim 16 which further comprises a rudder disposed aft of the first fluid accelerating rotor.

19. The improved propulsion system of claim 16 which further comprises a reversing mechanism that is disposed, at least in its majority, aft of the first fluid accelerating rotor.

20. The improved propulsion system of clam 19 wherein the reversing mechanism includes a reversing bucket element.

21. The improved propulsion system of claim 19 wherein the reversing mechanism includes at least two reversing bucket elements.

22. The improved propulsion system of claim 16 wherein a periphery of said first fluid accelerating rotor is, at least in its majority, surrounded by a rotor housing.

23. The improved propulsion system of claim 22 wherein said rotor housing includes a primary fluid inlet disposed, at least in its majority, forward of the first fluid accelerating rotor.

24. The improved propulsion system of claim 23 wherein the primary fluid inlet is in mechanical communication with one or more flow directing vanes.

25. The improved propulsion system of claim 24 wherein said flow directing vanes are, at least in part, airfoil shaped.

26. The improved propulsion system of claim 23 which further includes an air fence proximal the primary fluid inlet.

27. The improved propulsion system of claim 23 wherein the primary fluid inlet is proximal an angled surface that, as seen in a vertical transverse plane of the boat, is angled to horizontal over a majority of its width.

28. The improved propulsion system of claim 16 wherein the boat has multiple hulls.

29. The improved propulsion system of claim 16 wherein the boat is a monohull.

30. In an improved propulsion system for boats, the improvement comprising:

a first propulsion system including a first fluid accelerating rotor with said first fluid accelerating rotor operating with gas and water supplied to forward portions of said first fluid accelerating rotor when the boat is traveling forward at high speed, an elevation of a lower portion of said first fluid accelerating rotor proximal an elevation of a keel of the boat, and which further includes a secondary inlet fluid supply means to supply gas to the first fluid accelerating rotor when the boat is traveling forward at high speed and liquid to the first fluid accelerating rotor when the boat is traveling in reverse and which further comprises a reversing mechanism that is disposed, at least in its majority, aft of the first fluid accelerating rotor.

31. The improved propulsion system of claim 30 wherein a second propulsion system including a second fluid accelerating rotor with said second fluid accelerating rotor operating with gas and water supplied to forward portions of said second fluid accelerating rotor when the boat is traveling forward at high speed, an elevation of a lower portion of said second fluid accelerating rotor proximal an elevation of a keel of the boat, and which further includes a secondary inlet gas supply means to supply gas to the first fluid accelerating rotor when the boat is traveling forward at high speed and liquid to the second fluid accelerating rotor when the boat is traveling in reverse.

32. The improved propulsion system of claim 30 wherein the secondary inlet gas supply means includes a step that creates a waterline that separates the gas and the liquid when the boat is traveling forward at high speed.

33. The improved propulsion system of claim 30 which further comprises a rudder disposed aft of the first fluid accelerating rotor.

34. The improved propulsion system of claim 30 wherein the reversing mechanism includes a reversing bucket element.

35. The improved propulsion system of claim 30 wherein the reversing mechanism includes at least two reversing bucket elements.

36. The improved propulsion system of claim 30 wherein a periphery of said first fluid accelerating rotor is, at least in its majority, surrounded by a rotor housing.

37. The improved propulsion system of claim 36 wherein said rotor housing includes a primary fluid inlet disposed, at least in its majority, forward of the first fluid accelerating rotor.

38. The improved propulsion system of claim 37 wherein the primary fluid inlet is in mechanical communication with one or more flow directing vanes.

39. The improved propulsion system of claim 38 wherein said flow directing vanes are, at least in part, airfoil shaped.

40. The improved propulsion system of claim 37 which further includes an air fence proximal the primary fluid inlet.

41. The improved propulsion system of claim 37 wherein the primary fluid inlet is proximal an angled surface that, as seen in a vertical transverse plane of the boat, is angled to horizontal over a majority of its width.

42. The improved propulsion system of claim 30 wherein the boat has multiple hulls.

43. The improved propulsion system of claim 30 wherein the boat is a monohull.

* * * * *